US010494777B2

(12) United States Patent
Kanzaki et al.

(10) Patent No.: US 10,494,777 B2
(45) Date of Patent: Dec. 3, 2019

(54) ROAD STRUCTURE, CORROSION-RESISTANT CONDUCTIVE SHEET USED FOR THE ROAD STRUCTURE, AND METHOD FOR PEELING OFF ASPHALT LAYER

(71) Applicants: GREEN ARM CO., LTD., Tokyo (JP); TOYO ALUMINIUM K.K., Osaka (JP)

(72) Inventors: Yasushi Kanzaki, Tokyo (JP); Kazuo Kijima, Tokyo (JP); Atsuki Gomi, Tokyo (JP); Kenji Kihara, Tokyo (JP); Toshio Kunimatsu, Tokyo (JP); Yuya Terasawa, Osaka (JP); Tomonobu Sekiguchi, Osaka (JP); Kazunori Yamada, Kanagawa (JP); Hiroyuki Nishikawa, Osaka (JP); Hiroshi Oe, Osaka (JP); Kouichi Sugimoto, Tokyo (JP); Mayo Watanabe, Tokyo (JP)

(73) Assignees: GREEN ARM CO., LTD., Tokyo (JP); TOYO ALMINIUM K.K., Osaka (JP)

( * ) Notice: Subject to any disclaimer, the term of this patent is extended or adjusted under 35 U.S.C. 154(b) by 0 days.

(21) Appl. No.: 15/970,202

(22) Filed: May 3, 2018

(65) Prior Publication Data

US 2018/0282953 A1 Oct. 4, 2018

Related U.S. Application Data

(63) Continuation of application No. PCT/JP2016/082775, filed on Nov. 4, 2016.

(30) Foreign Application Priority Data

Nov. 4, 2015 (JP) ..... 2015-216619

(51) Int. Cl.
*E01C 9/00* (2006.01)
*E01C 23/08* (2006.01)
(Continued)

(52) U.S. Cl.
CPC ..... *E01C 23/081* (2013.01); *E01C 9/00* (2013.01); *E01C 23/12* (2013.01); *E01C 23/121* (2013.01);
(Continued)

(58) Field of Classification Search
CPC ..... E01C 9/00; E01C 23/081; E01C 23/12; E01C 23/121; E01C 23/14; H05B 6/36
(Continued)

(56) References Cited

U.S. PATENT DOCUMENTS 4,594,022 A * 6/1986 Jeppson ..... E01C 7/187 404/28
4,941,770 A * 7/1990 Gemmer ..... E01C 11/265 404/72
2009/0297268 A1 12/2009 Harakawa et al.

FOREIGN PATENT DOCUMENTS

JP H07-179828 A 7/1995
JP 2001-143862 A 5/2001
(Continued)

OTHER PUBLICATIONS

International Search Report issued in Application No. PCT/JP2016/082775, dated Jan. 17, 2017.

*Primary Examiner* — Raymond W Addie
(74) *Attorney, Agent, or Firm* — Michael Best & Friedrich LLP

(57) ABSTRACT

A road structure, an asphalt layer of which is peeled off by electromagnetic induction heating, includes a non-thermoplastic base layer, an asphalt layer located above the base layer, a conductive sheet between the base layer and the
(Continued)

asphalt layer, a first bonding layer that bonds the conductive sheet and the base layer; and a second bonding layer that bonds the conductive sheet and the asphalt layer. The conductive sheet is configured to generate heat based on electromagnetic induction. At least the first bonding layer is a thermoplastic bonding layer configured to be softened by the heat.

18 Claims, 5 Drawing Sheets

(51) Int. Cl.
*E01C 23/12* (2006.01)
*E01C 23/14* (2006.01)
*H05B 6/36* (2006.01)

(52) U.S. Cl.
CPC ..... *E01C 23/14* (2013.01); *H05B 6/36* (2013.01); *H05B 6/365* (2013.01)

(58) Field of Classification Search
USPC ..... 404/72, 75, 97
See application file for complete search history.

(56) References Cited

FOREIGN PATENT DOCUMENTS

| | | | |
|---|---|---|---|
| JP | 2003-165176 | A | 6/2003 |
| JP | 2007-146459 | A | 6/2007 |
| JP | 2007-291839 | A | 11/2007 |
| JP | 4330639 | B2 | 9/2009 |
| JP | 2013-142252 | A | 7/2013 |

* cited by examiner

ROAD STRUCTURE, CORROSION-RESISTANT CONDUCTIVE SHEET USED FOR THE ROAD STRUCTURE, AND METHOD FOR PEELING OFF ASPHALT LAYER

RELATED APPLICATIONS

This is a continuation of PCT/JP2016/082775 filed on Nov. 4, 2016 which claims Paris Convention priority based on Japanese Patent Application No. 2015-216619 filed on Nov. 5, 2015, the contents of these applications of which, including the specification, the claims and the drawings, are incorporated herein by reference in their entirety.

TECHNICAL FIELD

The present invention relates to a method for peeling off an asphalt layer as a road structure using a high-frequency electromagnetic induction coil, a road structure suitable for using the method, and a corrosion-resistant conductive sheet used for the road structure.

BACKGROUND ART

As a method for peeling off an asphalt layer paved on a base of a concrete slab which is generally non-electric conductive during a repair work of an asphalt-paved road or the like, a method of peeling off the asphalt layer from the concrete slab by a cutting machine is commonly used. However, when such method is used, a concrete slab which is not intended to be cut is cut by the cutting machine, and the concrete slab becomes thinner each time the asphalt layer is a peeled off during the repair work. In addition, microcracks may be made on the cut concrete slab due to impact thereon by the cutting machine, which deteriorates the concrete slab by corrosion, salt damage, freeze or the like of reinforcing steels in the concrete slab because of water entry, such as rain water, into the microcracks. Moreover, since problems of large vibration and/or noise are generated during the work, and the operation efficiency is extremely low, the application is limited to small-scale repair works.

With respect to a technique of peeling an asphalt layer paved on a steel plate deck of a bridge or the like, a removing method and apparatus as disclosed in Japanese Patent Number 4330639 are proposed. In the technique disclosed in Japanese Patent Number 4330639, the steel deck plate is subjected to electromagnetic induction heating to soften a part of the asphalt layer, and the softened layer is peeled off from the steel deck plate to peel of the asphalt layer. According to this technique, the asphalt layer can be peeled off from the steel deck plate without scratching the steel deck plate or making large vibration and/or noise.

Japanese Patent Application Publication No. 2013-142252 proposes a construction method of block pavement using heat based on electromagnetic induction. In this technique, a thermoplastic material and metal material are blended or laid in a bed mortal or on its surface which is to be laid on a base layer, and after paving blocks are laid and arranged on the bed mortal, electromagnetic induction is given from above the paving block so that the metal material is heated to soften the thermoplastic material, and the paving blocks are securely crimped to the bed mortal and located at predetermined positions. The softened thermoplastic material hardens during a process of returning to room temperature, and thus, the bed mortal and the paving blocks are integrated.

Japanese Patent Application Publication: No. JP H07-179828A discloses an adhesive sheet which is easily peeled from an adherend, and a method for peeling off the adhesive sheet. In this technique, the adhesive sheet is configured by a thermal adhesive layer using natural or petroleum asphalt, a heat generating layer laminated thereon, and a substrate layer laminated further thereon.

SUMMARY OF THE INVENTION

The present invention relates to a road structure, an asphalt layer of which can be peeled off by electromagnetic induction heating, includes a non-thermoplastic base layer, an asphalt layer located above the base layer, a conductive sheet between the base layer and the asphalt layer, a first bonding layer that bonds the conductive sheet and the base layer; and a second bonding layer that bonds the conductive sheet and the asphalt layer. The conductive sheet is configured to generate heat based on electromagnetic induction. At least the first bonding layer is a thermoplastic bonding layer configured to be softened by the heat.

A corrosion-resistant conductive sheet may be used. The corrosion-resistant conductive sheet having a conductor layer may be located between the first bonding layer and the second bonding layer, configured to generate heat base on electromagnetic induction. A corrosion-resistant film is preferably laminated on each side of the conductor layer. The conductor layer may preferably be any one of a metal layer, a fiber layer, a resin layer, or a layer in which a resin is mixed with a conductor, and a metal used for the conductor layer is preferably any one of a metal selected from a group consisting of alminium, stainless steel, iron, zinc, copper and titanium, and an alloy composed mostly of these metals.

The alminium or the alminium alloy used for the conductor layer may preferably have an electrical specific resistance of 6.0 $\mu\Omega\cdot$cm or more. The corrosion-resistant film may, preferably, be a glass-based film, a fluorinated film, an acrylic film, a styrene film, polycarbonate film, a polyester film, a polyurethane film, an epoxy film, a Teflon (Registered Trademark) film, a tin plating, a zinc plating, a zinc alloy clad, an oxide film, a phosphate treatment film, a phosphoric salt treatment film, a chromic acid treatment film, a chromate salt treatment film, a hydrofluoric acid treatment film, a hydrofluoric acid salt treatment film, a sodium salt treatment film, and a metal passive oxide film of any one selected from a group consisting of niobium, titanium, tantalum, silicon and zirconium formed by a cathode oxidation method, a sol-gel method, an alkoxide method, a CVD method or a PVD method, or combinations thereof.

The present invention provides, in a further aspect, a method for peeling off an asphalt layer from a base layer in the road structure according to the first aspect of the invention. The method comprises a step of softening a first bonding layer of the road structure by subjecting a corrosion-resistant conductive sheet of the road structure to electromagnetic induction heating from a side of the asphalt layer of the road structure, and a step of peeling the softened first bonding layer off the base layer to separate the base layer and the asphalt layer. The method preferably further comprises a step of softening a second bonding layer of the road structure by subjecting the corrosion-resistant conductive sheet to electromagnetic induction heating from the side of the asphalt layer of the road structure, and the separating step includes a step of, at any position of the softened first bonding layer and the second bonding layer, separating the layer located on the position and the layer located under the position. A softening point of the first bonding layer is preferably lower than that of the second bonding layer.

The first bonding layer may preferably be any one selected from a group consisting of synthetic rubber, acrylic resin, epoxy resin, acrylic acid, methacrylic acid, acrylic radical curable liquid resin, polyurethane resin, ethylene-vinyl acetate copolymer, urethane resin and bituminous material, or a mixture of these substances. The second bonding layer is preferably any one selected from a group consisting of ethylene-vinyl acetate copolymer, polyolefin resin, polyamide resin, polyester resin, polyurethane resin, polystyrene resin, polypropylene resin, polyvinyl acetate resin, polyethylene resin, polyethylene terephthalate resin, polyamide-imide resin, styrene-butadiene block copolymer (SBS) resin, chloroprene (CR) resin, styrene-isoprene block copolymer (SIS) resin, polybutadiene resin, and bituminous material, or mixture of these substances.

BRIEF DESCRIPTION OF THE DRAWINGS

FIGS. 1A and 1B show a road structure according to the present invention, wherein FIG. 1A shows a road structure without a watertight layer, and FIG. 1B shows a road structure with a watertight layer.

FIGS. 2A through 2C are diagrams showing a corrosion-resistant conductive sheet used for a road structure according to one embodiment of the present invention, and its usage state, wherein FIG. 2A is a perspective view when the corrosion-resistant conductive sheet is provided as a roll, FIG. 2B is a plan view showing a method for laying the corrosion-resistant conductive sheet on a flat road, and FIG. 2C is a side view showing a method for laying the corrosion-resistant conductive sheet on a ramp.

DETAILED DESCRIPTION OF THE EMBODIMENTS

Embodiments of the present invention are described in detail in the following.

Configuration of Road Structure 1

Figure 1B:
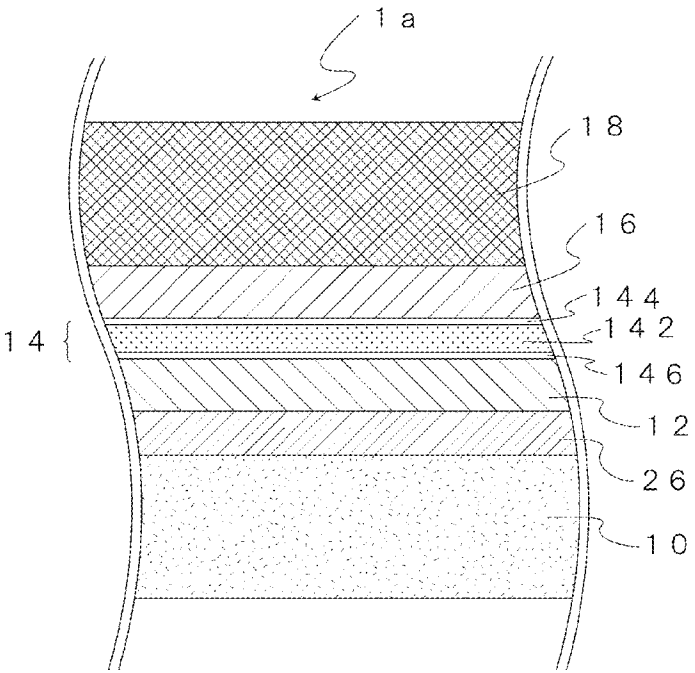
Figure 1A:
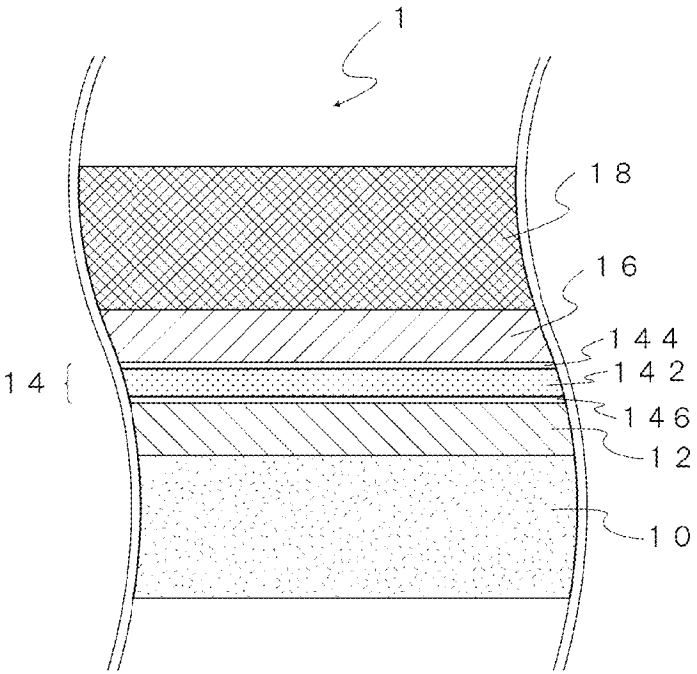

FIGS. 1A and 1B each shows a road structure according to one embodiment of the present invention. The road structure 1 or 1*a* shown in FIGS. 1A and 1B is formed such that an asphalt layer 18 is laminated over a base layer 10 which typically may be a concrete slab. On the base layer 10, a first bonding layer 12 is laminated, a corrosion-resistant conductive sheet 14 is laminated on the first bonding layer 12, a second bonding layer 16 is laminated on the corrosion-resistant conductive sheet 14, and the asphalt layer 18 is laminated on the second bonding layer 16. The first bonding layer 12 bonds the base layer 10 and the anti-corrosive conductive sheet 14, and the second bonding layer 16 bonds the corrosion-resistant conductive sheet 14 and the asphalt layer 18. This road structure 1 can be used such as for a common asphalt paved road, a concrete bridge, a culvert, a concrete structure for making a roof of a concrete building watertight.

The base layer 10 of the road structure 1 may be a cast-in-place concrete slab or precast concrete slab. A typical asphalt material can be used for the asphalt layer 18 of the road structure 1, but the material needs to be non-conductive, and what does not block a magnetic field. A thickness of the asphalt layer 18 is 2 to 3 cm or more and about 20 cm or less, preferably 8 cm or less.

The corrosion-resistant conductive sheet 14 is configured by a material which generates heat by an eddy current induced by electromagnetic conduction from outside and which state (for example, form, performance) does not change even buried between the asphalt layer 18 and the base layer 10 over a long period of time after being laid, and it may be, for example, a layer made entirely of a metal, a layer containing a metal for at least a part, a fiber layer, or a resin layer. Heat induced in the corrosion-resistant conductive sheet 14 can soften the first bonding layer 12, or the first bonding layer 12 and the second bonding layer 16. By making a layer 14 as a corrosion-resistant conductive sheet, the corrosion-resistant conductive sheet 14 can be heated by means of electromagnetic induction even a long period of time has passed after the road structure 1 is laid, and the asphalt layer 18 can be peeled off without scratching the base layer 10 or making large noise and vibration. Further, as a rule, since the corrosion-resistant conductive sheet 14 is discarded after the asphalt layer 18 is peeled off, a less expensive material is more preferred for configuration.

The corrosion-resistant conductive sheet 14 is of a thickness which allows for carrying a current necessary for generating heat at a degree which can soften the first bonding layer 12 or the second bonding layer 16 by electromagnetic conduction. In addition, the thickness has a strength such that the corrosion-resistant conductive sheet 14 does not break by a general external force acted thereon when the asphalt layer 18 is constructed on the corrosion-resistant conductive sheet 14. Since a thickness is proportional to weight, the thickness of the corrosion-resistant conductive sheet 14 can be arbitrarily selected from a viewpoint of a thickness and weight which do not interfere with conveyance and construction such as laying.

Preferably, the corrosion-resistant conductive sheet 14 is made by coating each side of a conductor layer 142 with corrosion-resistant films 144 and 146 respectively, or forming a material itself, by which the layer 14 is configured, by a corrosion-resistant material. The corrosion-resistant conductive sheet 14 may be any one of, for example, a metal layer having a corrosion-resistant film, a corrosion-resistant metal layer, a fiber layer having a corrosion-resistant film, a corrosion-resistant fiber layer, a resin layer having a corrosion-resistant film, a corrosion-resistant resin layer, a layer which has given a corrosion-resistant film to a mixture of a resin and a conductor, or a layer in which a corrosion-resistant resin is mixed with a conductor.

For the corrosion-resistant conductive sheet 14, for example, a sheet in which a flat sheet of conductor layer 142, a perforated sheet of conductor layer 142, or a net-like conductor layer 142 is coated with the corrosion-resistant films 144 and 146, or a sheet in which a corrosion-resistant conductive material is formed to, for example, a flat sheet, a perforated sheet, or a net, can be used. FIGS. 1A and 1B illustrate the corrosion-resistant conductive sheet 14 in which the corrosion-resistant films 144 and 146 are respectively laminated on each side of the flat sheet of conductor layer 142. When the conductor layer 142 is of a perforated one in which, for example, each of straight rows of holes aligned in a width direction of the conductor layer 142 is provided with appropriate distance in a length direction, a weight saving can be realized. The conductor layer 142 may have perforated cut lines. Using such perforated corrosion-resistant conductive sheet 14 and/or corrosion-resistant conductive sheet 14 with perforated cut lines may allow an easier peeling off process where the corrosion-resistant conductive sheet 14 is cut at such hole positions when a laminate including the corrosion-resistant conductive sheet 14 is peeled off from the base layer 10, as described in the following.

When the corrosion-resistant conductive sheet 14 is a layer made entirely of a metal, or a layer containing a metal for at least a part, alminium, stainless steel, iron, zinc, copper, and titanium, and an alloy composed mostly of these metals can be used as the metal.

The metal used for the corrosion-resistant conductive sheet 14 more preferably includes an alminium alloy, further preferably an alminium alloy foil, and much more preferably an alminium alloy foil which has a corrosion-resistant film on each side.

When the metal used for the corrosion-resistant conductive sheet 14 is made of an alminium alloy foil, or when an alminium alloy foil is contained at least a part therein, electrical specific resistance of the alminium alloy foil (room temperature 15° C.) is preferably 6.0 μΩ·cm or more, more preferably 6 to 10 μΩ·cm, and much more preferably 6.5 to 10 μΩ·cm. When the electrical specific resistance is less than 6.0 μΩ·cm, the thickness of the corrosion-resistant conductive sheet must be made thinner to obtain a necessary resistivity, which may lead to decrease in strength of the corrosion-resistant conductive sheet 14 to result in a breakage. The upper limit of the electrical specific resistance is typically about 10 μΩ·cm, but not specifically limited thereto. When the electrical specific resistance exceeds 10 μΩ·cm, a corrosion resistance may significantly be lowered, or processing may become difficult. Further, when a stainless steel foil is adopted as the metal used for the corrosion-resistant conductive sheet 14, the electrical specific resistance (room temperature 15° C.) is preferably 50 to 90 μΩ·cm, and more preferably 60 to 85 μΩ·cm.

When an alminium alloy foil 142 is used as the conductor layer 142 of the corrosion-resistant conductive sheet 14, the alminium alloy foil can be manufactured based on a known method; for example, it can be obtained by preparing a molten metal having a predetermined composition, and then applying a cold rolling to an alminium alloy casted to a thickness of 10 mm or less at a cooling rate of 100° C./second or more. As another method, it may be obtained by preparing a molten metal having a predetermined composition, and after homogenizing an ingot of an alminium alloy obtained by casting thereof at 450 to 660° C., preferably at 450 to 550° C., applying a hot rolling or cold rolling thereto. In the process of the cold rolling, annealing may be performed at 150 to 450° C. The obtained alminium alloy foil may be subjected to a final annealing at 200 to 600° C. according to necessity. Annealing time can be appropriately set, but a time to hold the temperature at 300° C. or more is preferably within 10 minutes. More preferable time to hold the temperature at 300° C. or more is within 1 minute.

The alminium alloy foil 142 is desirably as light as possible from a construction requirement, and as for stiffness, since high deformation performance is necessary because of a need for the following capability to the base layer underneath, the thickness is preferably 50 to 200 μm, but not limited thereto. The thickness of 50 μm or less may lead to decrease in strength as the corrosion-resistant conductive sheet 14, and when it exceeds 200 μm, construction and/or processing may become difficult.

In addition, an average grain size of the alminium alloy foil 142 is preferably 1 to 30 μm, more preferably 5 to 20 μm, and much more preferably 5 to 10 μm, but not limited thereto. The average grain size exceeding 30 μm may lead to difficulty in processing. Smaller average grain size is preferred, but is typically about 1 μm. Such alminium alloy foil 142 can be obtained by using an alminium alloy casted to a thickness of 10 mm or less at a cooling rate of 100° C./second or more. In this respect, the grain size in the present invention refers the maximum width of a crystal grain in a vertical direction with respect to a cold-rolling direction.

The alminium alloy which is a material of the alminium alloy foil 142 desirably contains Mn of $0.5 \leq Mn \leq 3.0$ percent by mass, Cr of $0.0001 \leq Cr < 0.20$ percent by mass, Mg of $0.2 \leq Mn \leq 1.8$ percent by mass, Ti of $0.0001 \leq Ti \leq 0.6$ percent by mass, Cu of $0 < Cu \leq 0.005$ percent by mass, Si of $0 < Si \leq 0.1$ percent by mass, and Fe of $0 < Fe \leq 0.2$ percent by mass. The rest of the alminium alloy excluding these alloy elements preferably consists of Al (alminium) and unavoidable impurities. Further, the content of each of the unavoidable impurities is desirably 100 mass ppm or less.

In the following, descriptions are provided in the order of each of alloy elements, electrical specific resistance.

Mn contained by $0.5 \leq Mn \leq 3.0$ percent by mass in the alminium alloy has a large contribution ratio for electrical specific resistance, and it is an element which does not lose corrosion resistance. In addition, coexistence with Cr further increases the electrical specific resistance. When the content of Mn is less than 0.5 percent by mass, a necessary electrical specific resistance may not be obtained, and when the content exceeds 3.0 percent by mass, the strength may become too large, leading to difficulty in the processing. The content of Mn is preferably $1.0 \leq Mn \leq 2.5$ percent by mass, more preferably $1.6 \leq Mn \leq 2.2$ percent by mass, and much more preferably $1.8 < Mn \leq 2.2$ percent by mass.

Cr contained by $0.0001 \leq Cr < 0.20$ percent by mass in the alminium alloy has a large contribution to electrical specific resistance, and it is an element which does not lose corrosion resistance. In addition, coexistence with Mn further increases the electrical specific resistance. When the content of Cr is less than 0.0001 percent by mass, a necessary electrical specific resistance may not be obtained, and when the content is 0.20 percent by mass or more, a hard and coarse Al—Cr—Mn based intermetallic compound may crystallize out, and thus, leading to defects such as pinholes. The content of Cr is more preferably $0.0001 \leq Cr \leq 0.18$ percent by mass.

Mg contained by $0.2 \leq Mg \leq 1.8$ percent by mass in the alminium alloy especially improves mechanical strength, and it is an element which also has a large contribution to electrical specific resistance. When the content of Mg is less than 0.2 percent by mass, a strength necessary for construction may not be obtained, and when the content exceeds 1.8 percent by mass, the strength may become too large, leading to difficulty in the processing Ti contained by $0.0001 \leq Ti \leq 0.6$ percent by mass in the alminium alloy has a large contribution ratio for electrical specific resistance, and it is an element which does not lose corrosion resistance, and improves its formability by refining crystal grains of the alminium alloy. When the content of Ti is less than 0.0001 percent by mass, a necessary electrical specific resistance may not be obtained, and also, the average grain size of the alminium alloy foil may become large, leading to difficulty in processing. In addition, when the content exceeds 0.6 percent by mass, the strength may become too large, leading to difficulty in the processing. The content of Ti is preferably 0.002≤Ti≤0.25 percent by mass.

a. Cu contained by 0<Cu≤0.005 percent by mass in the alminium alloy is an element which lowers the corrosion resistance. When the content of Cu exceeds 0.005 percent by mass, corroded pores may be formed in the alminium alloy foil. Here, the lower limit of the Cu content is typically about 0.0005 percent by mass but not specifically limited thereto. The content of Cu is more preferably 0<Cu≤0.003 percent by mass.

Si contained by 0<Si≤0.1 percent by mass in the alminium alloy is an element which lowers the electrical specific resistance to facilitate deposition of other elements. In addition, it is an element which lowers corrosion resistance especially to a weak acid. When the content of Si exceeds 0.1 percent by mass, corroded pores may be formed in the alminium alloy foil. The lower limit of the Si content is typically about 0.0005 percent by mass but not specifically limited thereto. The content of Si is more preferably 0<Cu≤0.04 percent by mass.

Fe contained by 0<Fe≤0.2 percent by mass in the alminium alloy is an element which specifically improves mechanical strength but lowers corrosion resistance. When the content of Fe exceeds 0.2 percent by mass, corroded pores may be formed in the alminium alloy foil. The lower limit of the Fe content is typically about 0.0005 percent by mass but not specifically limited thereto. The content of is more preferably 0<Fe≤0.08 percent by mass.

Al which is a main component of the alminium alloy is excellent in heat conductivity, light, inexpensive, and easy to be processed. Here, elements such as Fe, Si, Cu, Ti, V, Ga get mixed in as impurity elements typically in a process of smelting, purifying, and ingotting of alminium, but the content of such elements can be adjusted by combining and blending various qualities (grades) of alminium. The alminium alloy used for the corrosion-resistant conductive sheet 14 according to the present invention is manufactured by adding and blending a certain kind of element as a significant element after the impurity elements are adjusted.

The alminium alloy foil 142 consisting of this alminium alloy can contain each of the above-described elements in a range where the electrical specific resistance (room temperature 15° C.) is 6.0 μΩ·cm or more, preferably 6.0 to 10 μΩ·cm, more preferably 6.5 to10 μΩ·cm. When the electrical specific resistance is less than 6.0 μΩ·cm, the thickness of the corrosion-resistant conductive sheet must be made thinner to obtain a necessary resistivity, leading to decrease in strength of the corrosion-resistant conductive sheet 14. The upper limit of the electrical specific resistance is typically about 10 μΩ·cm, but not specifically limited thereto. It is because when the electrical specific resistance exceeds 10 μΩ·cm, corrosion resistance may significantly be lowered, or processing may become difficult.

The material of the corrosion-resistant films 144 and 146 used for the corrosion-resistant conductive sheet 14 according to necessity may be any material as long as the conductor layer 142 can be protected from corrosion, but not specifically limited thereto. As the corrosion-resistant films 144 and 146, for example, a glass-based film, a fluorinated film, an acrylic film, a styrene film, polycarbonate film, a polyester film, a polyurethane film, epoxy film, a Teflon (Registered Trademark) film, a tin plating, zinc plating, a zinc alloy clad, an oxide film, phosphate treatment film, a phosphoric salt treatment film, a chromic acid treatment film, a chromate salt treatment film, a hydrofluoric acid treatment film, a hydrofluoric acid salt treatment film, a sodium salt treatment film, or any one selected from a group consisting of niobium, titanium, tantalum, silicon and zirconium metal passive oxide film formed by a cathode oxidation method, a sol-gel method, an alkoxide method, a CVD method or a PVD method, or combinations thereof may be used. The corrosion-resistant films 144, 146 are more preferably a glass-based film or an epoxy film. Each of the films 144 and 146 preferably has good bonding characteristic with the first bonding layer 12 and the second bonding layer 16, and has high slipping-resistance characteristic, tensile strength-resistance characteristic, stripping-resistance characteristic etc.

The first bonding layer 12 is located between the base layer 10 and the corrosion-resistant conductive sheet 14, as shown in FIG. 1, and it is a thermoplastic material which may rigidly bond the base layer 10 and the corrosion-resistant conductive sheet 14 when the corrosion-resistant conductive sheet 14 is laid, and be softened by heat induced in the corrosion-resistant conductive sheet 14 when the asphalt layer 18 is peeled off. When the asphalt layer is peeled off, the first bonding layer 12 may be softened by the heat of the corrosion-resistant conductive sheet 14 which generates heat by means of electromagnetic conduction, lowering a bonding force between the base layer 10 and the corrosion-resistant conductive sheet 14 to allow for separating layers located on and under the first bonding layer 12.

The first bonding layer 12 preferably has a softening point T1 determined by a softening point test method generally used in an asphalt characteristic test of about 50° C. to about 80° C., and it is more preferable to be 10 to 15° C. or more lower than a softening point T2 of the second bonding layer 16 described in the following. Here, the softening point is an index showing a temperature when a solid substance of a thermoplastic material such as asphalt plastically deforms continuously by an increase in temperature, and softens to a predetermined degree. For example, the softening point of asphalt is a temperature where asphalt is dipped as low as a defined distance when a steel ball is put on asphalt which has been poured into a ring-shaped form in a melted liquid state and then cooled and solidified, and the temperature is elevated with a certain temperature gradient. When a material having a lower softening point than the second bonding layer 16 is used as a material of the first bonding layer 12, and a temperature at which the corrosion-resistant conductive sheet 14 generates heat by means of electromagnetic induction is controlled to a temperature with which the first bonding layer 12 softens but the second bonding layer 16 does not, the layers located on and under the first bonding layer 12 are easily separated.

A relationship between a difference of the softening points of the first bonding layer 12 and the second bonding layer 16, and a position to separate the road structure 1 into two layers may be considered as in the following. A relationship between temperature (Tem) and a degree of viscosity (η) of the materials used for the first bonding layer 12 and the second bonding layer 16 is represented as a curve approximated to a negatively sloped nearly straight line on a temperature (Tem)—viscosity (η) characteristic diagram of the materials used for the bonding layers. This temperature-viscosity characteristic diagram is commonly represented as "log (log η)-log (Tem)" diagram in which a logarithm of temperature (log (Temη)) is made as the horizontal axis, and a log-log of viscosity (log (log η)) is made as the vertical axis. Alternatively, this temperature—viscosity characteristic diagram is sometimes represented as a characteristic diagram in which temperature (Tem) is made as the horizontal axis, and a logarithm of viscosity (log η) is made as the vertical axis, that is, a "log η-Tem" diagram. On this characteristic diagram, a straight line representing the second bonding layer 16 may be plotted above a straight line representing the first bonding layer 12 which softening point is lower, with a certain distance. When the first bonding layer 12 and the second bonding layer 16 are simultaneously heated by heat of the corrosion-resistant conductive sheet 14, and the temperature reaches where the first bonding layer 12 softens, the second bonding layer 16 has a viscosity at a point spaced by the above distance, that is, the viscosity where the softening does not start yet. Here, the vertical axis is represented as the log-log as described in the above, thus, even if the difference between the softening point of the first bonding layer 12 and the softening point of the second bonding layer 16 is 10° C. to 15° C., a difference of viscosity which corresponds to the difference of softening points is large. Therefore, by making the first bonding layer 12 and the second bonding layer 16 with materials which difference of the respective softening points is 10 to 15° C. or more, when the corrosion-resistant conductive sheet 14, which makes up the road structure 1, is heated by generating induction current inducing current by means of electromagnetic conduction, the layers located on and under the first bonding layer 12, which has lower viscosity, are more easily separated, not the second bonding layer 16.

The first bonding layer 12 is desirably made of a material which state (corrosion resistance, bonding between the base layer 10 and the corrosion-resistant conductive sheet 12 etc.) does not change even if a situation continues where it is buried between the asphalt layer 18 and the base layer 10 for a long period of time.

The material which may be used as the first bonding layer 12 may be, for example, any one selected from a group consisting of, synthetic rubber, acrylic resin, epoxy resin, acrylic acid, methacrylic acid, acrylic radical curable liquid resin, polyurethane resin, ethylene-vinyl acetate copolymer, urethane resin, and bituminous material, or mixture of these substances, but not limited thereto.

A thickness of the first bonding layer 12 may be any thickness as long as the base layer 10 and the corrosion-resistant conductive sheet 14 are securely bonded. In addition, when the base layer 12 is uneven, the thickness may be determined such that the unevenness is absorbed during laying of the corrosion-resistant conductive sheet 14 to securely attach the corrosion-resistant conductive sheet 14 and the base layer 10. However, the thickness is preferably as thin as possible from a viewpoint of workability and economic efficiency.

The second bonding layer 16 is located between the corrosion-resistant conductive sheet 14 and the asphalt layer 18, as shown in FIGS. 1A and 1B, and it is a thermoplastic material which may rigidly bond the corrosion-resistant conductive sheet 14 and the asphalt layer 18 when the asphalt layer 18 is laid, and be softened by heat induced in the corrosion-resistant conductive sheet 14 when the asphalt layer 18 peeled off. The second bonding layer 16 may be softened by the heat of the corrosion-resistant conductive sheet 14 which generates heat by means of electromagnetic conduction when the asphalt layer 18 is peeled off, lowering a bonding force between the corrosion-resistant conductive sheet 14 and the asphalt layer 18 to allow for separating layers located on and under the second bonding layer 16.

The second bonding layer 16 preferably has a softening point T2 of about 60° C. to about 90° C., and it is more preferable to be 10° C. to 15° C. or more higher than the softening point T1 of the first bonding layer 12 as described in the description of the first bonding layer 12. When a material having a higher softening point than the first bonding layer 12 is used as a material of the second bonding layer 16, and a temperature at which the corrosion-resistant conductive sheet 14 generates heat by means of electromagnetic induction is controlled to a temperature with which the first bonding layer 12 softens but the second bonding layer 16 does not, the layers located on and under the first bonding layer 12 are easily separated.

The second bonding layer 16 is desirably made of a material which state (corrosion resistance, bonding between the corrosion-resistant conductive sheet 14 and the asphalt layer 18 etc.) does not change even if a situation continues where it is buried between the asphalt layer 18 and the base layer 10 for a long period of time. A thickness of the second bonding layer 16 may be any thickness as long as the corrosion-resistant conductive sheet 14 and the asphalt layer 18 are securely bonded, but the thickness is preferably as thin as possible from a viewpoint of workability and economic efficiency.

The material which may be used as the second bonding layer 16 may be any one selected from a group consisting of, for example, ethylene-vinyl acetate copolymer, polyolefin resin, polyamide resin, polyester resin, polyurethane resin, polystyrene resin, polypropylene resin, polyvinyl acetate resin, polyethylene resin, polyethylene terephthalate resin, polyamide-imide resin, styrene-butadiene block copolymer (SBS) resin, chloroprene (CR) resin, styrene-isoprene block copolymer (SIS) resin, polybutadiene resin, and bituminous material, or mixture of these substances, but not limited thereto.

Corrosion-Resistant Conductive Sheet

Figure 2A:
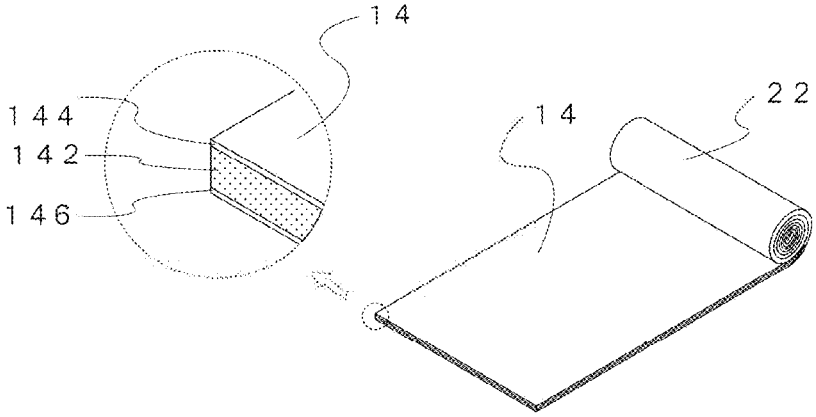

The corrosion-resistant conductive sheet 14 shown in FIGS. 1A and 1B can be carried into a construction site in a form, for example, of a corrosion-resistant conductive sheet 14 preliminarily processed to a band-like sheet. FIG. 2A shows a roll 22 of corrosion-resistant conductive sheet 14 as an example. Such corrosion-resistant conductive sheet 14 may allow for laying the road structure 1 easily by laying the first bonding layer 12 on the base layer 10, taking the corrosion-resistant conductive sheet 14 out from the roll 22, for example, for laying thereon, bonding the base layer 10 and the corrosion-resistant conductive sheet 14 through the first bonding layer 12, laying the second bonding layer 16 on the corrosion-resistant conductive sheet 14, laying the asphalt layer 18 thereon, and bonding the corrosion-resistant conductive sheet 14 and the asphalt layer 18 through the second bonding layer 16.

The corrosion-resistant conductive sheet 14 is exampled in FIG. 2A as a form in which the band-like sheet is rolled into the roll 22, but not limited thereto. For example, a plurality of rectangular corrosion-resistant conductive sheets 14 may be prepared to be laid out on the second bonding layer 12.

Configuration of Road Structure 1

FIG. 1B shows a road structure according to the second embodiment of the present invention. The road structure 1*a* shown in FIG. 1B is different from the first embodiment of the present invention in that a watertight layer 26 is located between the base layer 10 and the first bonding layer 12.

The watertight layer 26 is located between the base layer 10 and the first bonding layer 12 as shown in FIG. 1B, and functions to prevent water entered in the road structure 1*a* from reaching the base layer 10. The watertight layer 26 is preferably made of a material which watertight performance does not change even if it is buried between the asphalt layer 18 and the base layer 10 over a long period of time. In addition, the material for the watertight layer 26 preferably has a high bonding characteristic with the base layer 10 and the first bonding layer 12. As the watertight layer 26, a coated watertight layer, a watertight sheet, a mortar+watertight sheet layer etc. may be used.

As the coated watertight layer, for example, a synthetic rubber watertight layer, a combination of a high ductility FRC material and a resin material, a combination of an acrylic resin and an asphalt-based bonding layer, a combination of an epoxy resin and an asphalt-based bonding layer, a composite polymer resin of acrylic acid and methacrylic acid, a combination of an acrylic radical curable liquid resin and an asphalt watertight agent, a combination of a polyurethane resin, urethane adhesive, and an ethylene vinyl acetate, or a combination of an urethane watertight layer and urethane reactive hotmelt adhesive etc. may be used, but not limited thereto.

As the watertight sheet, for example, a pour and bond type sheet, a heat and contact sheet, an ambient temperature non-pressuring bonding sheet, an ambient temperature pressuring bonding sheet, a watertight layer made by sandwiching a fiber sheet between asphalt etc. may be used, but not limited thereto.

As the mortar+watertight sheet layer, for example, a watertight layer made by mending the base layer with a cement-based mortal and emulsion and then applying an asphalt-based watertight sheet, a watertight layer in which a reinforcement layer having a fiber sheet sandwiched between resin mortals, and a watertight sheet, and an asphalt rubber adhesive are combined, a watertight layer in which a non-woven fabric is sandwiched between stretching materials consisting of a hydraulic cement and a synthetic resin emulsion may be used, but not limited thereto.

Peeling Apparatus

A peeling apparatus for peeling the asphalt layer 18 in the road structure 1, 1*a* has components of, basically, an electromagnetic induction coil which may heat the corrosion-resistant conductive sheet 14 included in the road structure 1, 1*a* by means of electromagnetic conduction, a high-frequency power generating unit and a power source which may supply a high-frequency power to the electromagnetic induction coil, and a peeling member which wedge-shaped tip is inserted into the heated and softened bonding layer to allow for separating the base layer 10 and the asphalt layer 18. The peeling apparatus is preferably a low-noise and low-vibration apparatus, and more preferably, a noise-free and vibration-free apparatus. The peeling apparatus is preferably an apparatus which can heat the conductive sheet so that the bonding layer is softened to a degree necessary to peel off the asphalt layer, and which is a self-propelled apparatus enabling the electromagnetic conductive coil to move at a certain speed, for example, an apparatus of a type which a self-propelled vehicle tows the electromagnetic induction coil, and more preferably which includes a magnetic flux shielding mechanism to prevent a magnetic flux from the electromagnetic induction coil from leaking outside. In addition, the peeling apparatus preferably includes a mechanism for moving the electromagnetic induction coil, which allows the coil position to be controlled freely so that the electromagnetic induction coil can be located at an arbitrary position on the upper surface of the asphalt layer depending on a road surface condition.

Figure 3:
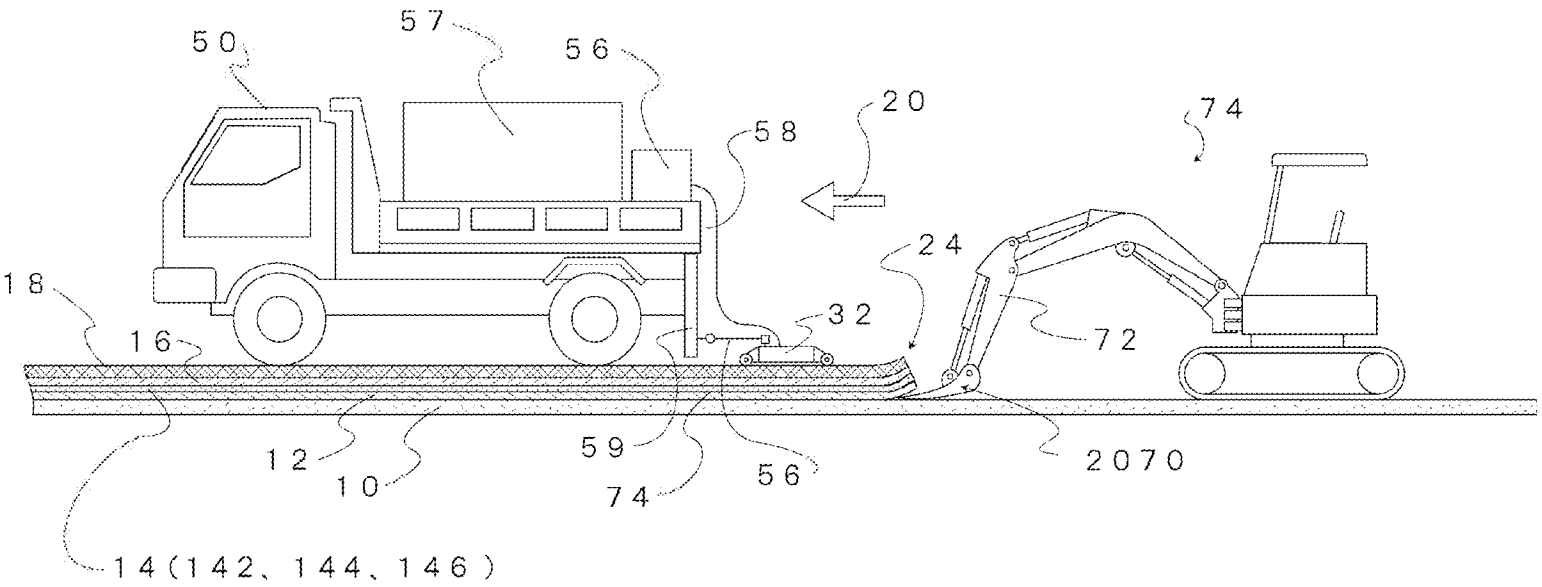
FIG. 3 shows an example of an apparatus configuration for peeling off an asphalt layer in a road structure according to one embodiment of the present invention.

FIG. 3 shows an apparatus for peeling off the asphalt layer 18 in the road structure 1 or 1*a* according to an embodiment of the present invention. This apparatus is an example of a basic configuration, and not limited to hereto.

As shown in FIG. 3, on the base layer 10, the first bonding layer 12, the corrosion-resistant conductive sheet 14, the second bonding layer 16 and the asphalt layer 18 are laminated in this order. A truck for loading and towing apparatus 50 is on the asphalt layer 18. A forward moving direction 20 of the truck for loading and towing apparatus 50 is a direction which the asphalt layer 18 is peeled (hereinafter "peeling direction"). Further, in FIG. 3, to facilitate understanding, each of the thickness of the first bonding layer 12, the corrosion-resistant conductive sheet 14, and the second bonding layer 16 is shown thicker than reality. In addition, in the following, an apparatus and method for peeling off the asphalt layer 18 in the road structure 1 are described, but the same apparatus can be used also in the road structure 1*a*.

Figure 4A:
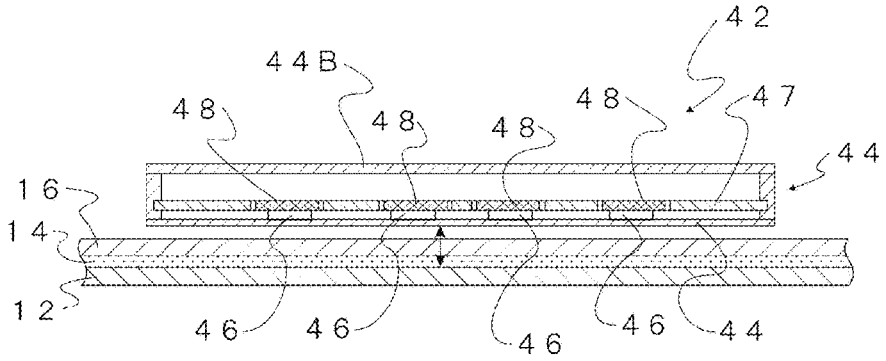
FIGS. 4A and 4B show an example of a configuration of an electromagnetic induction coil unit mounted on the apparatus shown in FIG. 3.
Figure 4B:
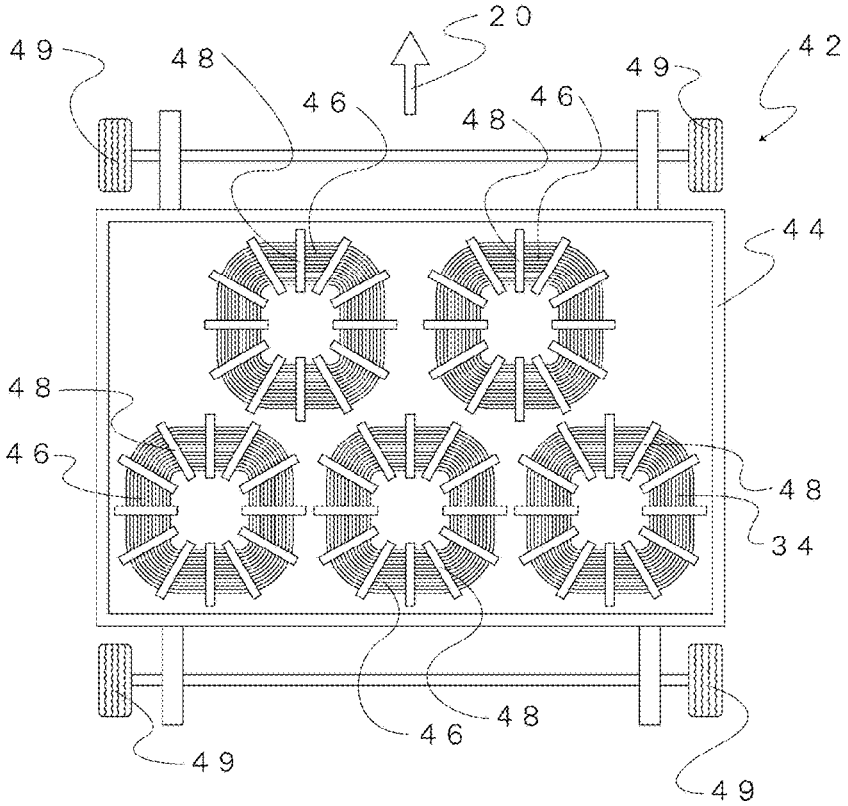

As shown in FIG. 3, an electromagnetic induction coil unit 32 is on the upper surface of the asphalt layer 18 at a position on a trailing side relative to the truck for loading and towing apparatus 50. FIGS. 4A and 4B show an example of a coil unit suitable in using for a peeling method according to the present invention. The coil unit 32 is arranged as that, as shown in a plan view of FIG. 4B, when a direction shown by an arrow 20 is a traveling direction (peeling direction), three electromagnetic induction coils 46 are arranged with even intervals in a lateral direction which passes transversely across the traveling direction at the rear inside of a frame member 44 made of FRP, for example. In addition, at the front thereof, two electromagnet induction coils 46 are arranged in the lateral direction, with a distance approximately half of a coil being displaced with respect to the arrangement of the rear electromagnetic induction coils 46. Such arrangement of the electromagnetic induction coils with respect to the traveling direction enables uniform application of current based on electromagnetic induction to the corrosion-resistant conductive sheet 14, and thus, more uniform heating of the corrosion-resistant conductive sheet 14 is possible. Further, the arrangement of the electromagnetic induction coils 46 in the coil unit 32 is not limited to the arrangement shown in FIGS. 4A and 4B, and it is preferable to design thereof depending on a condition of the road structure 1 including the asphalt layer 18 and/or a form of the corrosion-resistant conductive sheet 14.

FIG. 4A is a cross-sectional view passing transversely across a center part of the two electromagnetic induction coils 46 arranged at the front relative to the traveling direction 20 in FIG. 4B. As shown in FIG. 4A, the electromagnetic induction coils 46 are secured to the frame member 44, and on each of the upper surfaces of the electromagnetic induction coils 46, ferrite members 48 are arranged radially with respect to a center of the electromagnetic induction coils 46. The frame member 44 has a board 47 formed to have a thickness approximately equal to that of the ferrite member 48 and provided at a vertically intermediate layer thereof to extend approximately in a horizontal direction. A top plate 44B of the frame member 44 is preferably a detachable cover. This makes it possible to promote heat release to the outside of the frame member 44 when the electromagnetic induction coils 46 are in a high-temperature state. In addition, the top plate 44B can be detached to facilitate a maintenance operation for the electromagnetic induction coils 46. Four wheels 49 are provided in respective four corners of the frame member 44. The coil unit 42 is adapted to allow a plurality of the coil units 42 to be connected to each other in the lateral direction.

With a view to enhance heating efficiency of the electromagnetic induction coils 46, a lower surface of each of the electromagnetic induction coils 46 is preferably disposed in adjacent relation to the upper surface of the asphalt layer 18 as close as possible to reduce a distance between the upper surface of the corrosion-resistant conductive sheet 14 and the lower surface of the electromagnetic induction coils 46.

As shown in FIG. 3, a high-frequency power generating unit 56 for supplying a high-frequency power to the electromagnetic induction coils 46 via an electric cable 58, and a power generator 57 serving as a power source of the high-frequency power generating unit 56, are mounted on a loading platform of the truck for loading and towing apparatus 50. A supporting column 59 is fixed to a rear end of the truck for loading and towing apparatus 50 to protrude downwardly, and the supporting column 59 is coupled to the coil unit 32 through a fixture or pulling wire 56 integrated with the truck for loading and towing apparatus 50, or integrally connected thereto.

A small turning-type backhoe 74 with a ripper 70 serving as a peeling member attached to a distal end of an arm 72 is driven onto the base layer 10 at a position on a trailing side relative to the coil unit 42.

Peeling Method

Next, an operation process for implementing the peeling method of the asphalt layer 18 in the road structure 1 according to an embodiment of the present invention will be described below with reference to FIG. 3. In starting the peeling operation, a part of the base layer 10 where the backhoe 74 and the ripper 70 are placed is preferably exposed in advance as a part to allow for the ripper 70 to start the peeling operation.

Especially when the corrosion-resistant conductive sheet 14 is made of a flat sheet metal, a plurality of cut lines substantially parallel to the travelling direction 20 are preferably formed in the asphalt pavement 18 of the road structure 1 such as by a cutting blade (not shown) before starting the peeling process, from a viewpoint of easy operation. For example, when two cut lines are formed, the asphalt pavement 18 may be segmented into three lanes extending in the traveling direction 20. In addition, a plurality of cut lines may be formed in the asphalt pavement 18 of the road structure 1 such as by the cutting blade in a direction passing transversely across the traveling direction 20. Such cut lines facilitate the asphalt layer 18 to be peeled off and removed from above the base layer 10.

Next, the coil unit 42 is placed at a position to be peeled off (hereinafter "peeling position") which is, for example, the extreme of the three lanes, on the asphalt pavement 18. Further, when the asphalt pavement 18 is segmented into a plurality of lanes, each of the coil units 42 may be placed on the corresponding lanes to peel off the respective asphalt layers 18 simultaneously from all of the lanes. When a high-frequency power is supplied from the high-frequency power generating unit 56 to the electromagnetic induction coils 46 of the coil units 42 via the electric cable 58, an eddy current based on electromagnetic induction is produced in the corrosion-resistant conductive sheet 14 of the road structure 1 located below the coil units 42 to generate heat due to an electric resistance of its own. When the corrosion-resistant conductive sheet 14 generates heat, the first bonding layer 12 contacting with the corrosion-resistant conductive sheet 14 softens.

Then, in conjunction with initiation of the heating, the truck for loading and towing apparatus 50 is moved in the forward traveling direction to pull each of the coil units 42 so as to gradually move the coil units 42 in the peeling direction 20. A moving speed of the coil unit 42 may be appropriately set depending on a heating capability of the coil unit 42 and a desired speed of the peeling operation. The two electromagnetic induction coils 46 at the front are arranged in side-by-side relation to each other in the lateral direction, with a distance approximately half of a coil being displaced with respect to the arrangement of the electromagnetic induction coils 46 at the rear, and thus, the eddy current may be produced in the corrosion-resistant conductive sheet 14 entirely without any space.

Then, the ripper 70 may be inserted into the softened first bonding layer 12 to peel off the asphalt pavement 18 from the base layer 10. Ideally, the tip of the ripper 70 is preferably inserted between the base layer 10 and the first bonding layer 12. When the road structure 1 is configured by using materials, where softening point of the material of the first bonding layer 12 is lower than that of the second bonding layer 16, the first bonding layer 12 softens the most in each of the layers included in the road structure 1, and the layers above the first bonding layer 12 are all solidly fixed and integrated when the peeling operation is performed, and thus, the peeling is naturally caused at the first bonding layer 12 part, and the corrosion-resistant conductive sheet 14, the second bonding layer 16 and the asphalt layer 18 are integrally separated from the base layer 10. However, in a real road structure, while the total thickness of the first bonding layer 12, the corrosion-resistant conductive sheet 14 and the second bonding layer 16 is a few mm to a few dozen mm, a thickness of the tip of the ripper 70 commonly used is a few dozen mm (for example, about 30 mm). Therefore, the tip of the ripper 70 is not inserted into a certain one of the first bonding layer 12, the corrosion-resistant conductor layer 14, and the second bonding layer 16, but these layers are collectively hooked and lifted, and peeled from the layer which bonding force became the lowest during such time.

In a case where a sheet with weakness is used as the corrosion-resistant conductive sheet 14, in which weakness to tensile break such as a plurality of holes or perforations are provided with appropriate spaces in a direction orthogonal to a peeling direction of the conductor layer 142, for example, in a case of a band-like sheet, in which a row of weakness straightly aligned in a cross direction of the sheet are provided with appropriate spaces in a length direction, when the layer including the corrosion-resistant conductive sheet 14 is peeled and lifted by the ripper 70, the peeled portion and the not-peeled portion can be fragmented at this weak part, and thus, the peeling step can be performed more easily.

The process after the peeling of a layer 24 from the first bonding layer 12 to the asphalt layer 18 (or, a plurality of layers 24 at least including the asphalt layer 18), peeled off from the base layer 10 by the ripper 70 is not specifically limited. For example, the peeled off layer 24 including the asphalt layer 18 may be cut to appropriately length with respect to the travelling direction 20, or may be cut at cut lines provided in advance, and then lifted by the ripper 70 and leave it on a side of the road structure 1 by turning the arm 72 of the backhoe 74. The peeled off layer 24 left aside is taken out in the later step. Alternatively, the peeling apparatus may be moved continuously in the traveling direction 20, with the peeled layer 24 including the asphalt layer 18 remaining on the base layer 10 to remove the peeled layer 24 remaining on the base layer 10 later. This process enables protecting the exposed base layer 10 by fracture pieces of the peeled layer 24.

Laying Process

Next, a laying process of the road structure 1 according to the present invention is described. The configuration of the road structure 1 is shown in FIG. 1A.

First, the base layer 10 is laid by cast-in-place of concrete or by locating a preliminarily constructed concrete slab etc. on a laying position. Then, the first bonding layer 12 is laid on the base layer 10. The first bonding layer 12 is laid such as by blowing or coating a material heated to an appropriate melting temperature on the base layer 10. The first bonding layer 12 may double a primer coated on a surface of the base layer 10, but a primer may be separately coated on the surface of the base layer 10 before the first bonding layer 12 is laid, according to necessity.

The road structure 1*a* shown in FIG. 1B shows a case where the watertight layer 26 is laid on the base layer 10 before the first bonding layer 12 is laid. The watertight layer 26 is laid on the base layer 10 by a common construction method such as coating, blowing, pouring and bonding, heat welding, adhesion at a normal temperature depending on a material of the watertight layer 26 used. After the watertight layer 26 is laid, the first bonding layer 12 is laid thereon as described in the above.

In both cases of the road structure 1 and 1*a*, the corrosion-resistant conductive sheet 14 is laid on the first bonding layer 12. The corrosion-resistant conductive sheet 14 may be a corrosion-resistant conductive sheet preliminarily processed to a band-like sheet form as shown in FIG. 2A. For example, when the corrosion-resistant conductive sheet 14 is prepared as a roll 22, the corrosion-resistant conductive sheet 14 can be laid by setting the roll 22 above the first bonding layer 12, taking the corrosion-resistant conductive sheet 14 out from the roll 22, positioning the taken out sheet 14 on a predetermined position of the first bonding layer 12, and at the same time, cutting the sheet by an appropriate length depending on predetermined laying zones. Alternatively, when the corrosion-resistant conductive sheet 14 is prepared as a rectangular sheet divided into a predetermined size, for example, about 50 cm to 180 cm square size, the corrosion-resistant conductive sheet 14 can be laid by arranging a plurality of rectangular sheets 14 on the first bonding layer 12.

Figure 2B:
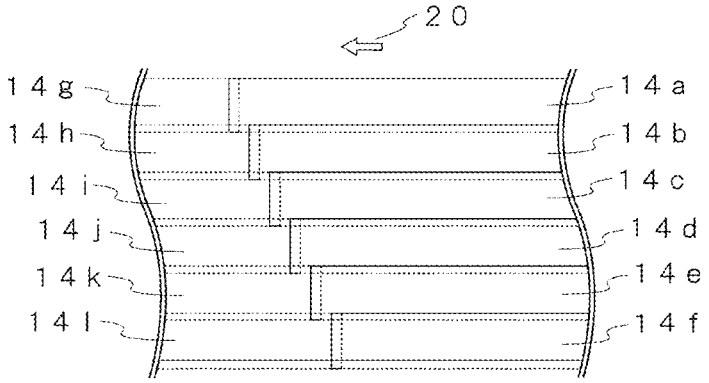

When laying the corrosion-resistant conductive sheet 14, as shown in FIG. 2B, the corrosion-resistant conductive sheet 14 is preferably laid with its ends overlapped so that no gap may exist between adjacent sheets. Alternatively, the corrosion-resistant conductive sheet 14 may be laid such that end faces of adjacent sheets surely come end-to-end with each other. When the ends are overlapped for the laying, specifically, first, the corrosion-resistant conductive sheet 14*a* is laid at a position shown at the upper part of FIG. 2B in a laying direction shown by an arrow 20. Then, the corrosion-resistant conductive sheet 14*b* is positioned such that the right-side end thereof in the traveling direction overlaps the left-side end of the corrosion-resistant conductive sheet 14*a*, and also, the tip portion thereof is located rear in the traveling direction than the tip portion of the corrosion-resistant conductive sheet 14*a*. Then, corrosion-resistant conductive sheets 14*c* to 14*f* are similarly laid.

Next, the corrosion-resistant conductive sheet 14*g* is similarly laid. The corrosion-resistant conductive sheet 14 is located such that the right-side end thereof in the traveling direction corresponds with the right-side end of the corrosion-resistant conductive sheet 14*a*, and the rear end thereof overlaps the tip of the corrosion-resistant conductive sheet 14*a*. Next, the corrosion-resistant conductive sheet 14 is located such that the right-side end thereof overlaps the left-side end of the corrosion-resistant conductive sheet 14*g*, and the rear end overlaps the tip of the corrosion-resistant conductive sheet 14*b*. Then, corrosion-resistant conductive sheets 14*i* to 14*l* are similarly laid. Thus, a watertight effect can be improved by laying the corrosion-resistant conductive sheets 14 such that the ends overlap with each other. In a case where the watertight layer 26 is laid, it is more efficient when the ends of the corrosion-resistant conductive sheet 14 are located such that they come end-to-end, not overlapped.

Figure 2C:
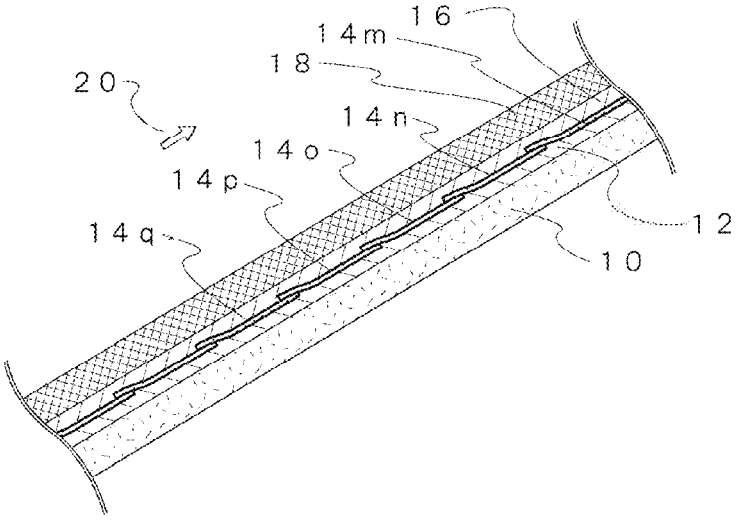

When the corrosion-resistant conductive sheet 14 is laid on a ramp, as shown in FIG. 2C, the corrosion-resistant conductive sheets 14*m* to 14*r* are preferably laid such that an end at the upper side of the ramp of the corrosion-resistant conductive sheet 14 laid at the lower side of the ramp is slid under an end at the lower side of the ramp of the corrosion-resistant conductive sheet 14 laid at the upper side of the ramp. Thus, the corrosion-resistant conductive sheet 14 is laid, with the upper end of the corrosion-resistant conductive sheet 14 located at the lower side of the ramp is positioned under the lower end of the corrosion-resistant conductive sheet 14 located at the upper side of the ramp to allow for improving the watertight effect to water flowing from the upper side to the lower side of the ramp.

Subsequently, the second bonding layer 16 is laid on the corrosion-resistant conductive sheet 14 laid as described in the above. The second bonding layer 16 is laid by, for example, blowing or coating a material heated to an appropriate melting temperature on the corrosion-resistant conductive sheet 14. Finally, the asphalt layer 18 is laid on the second bonding layer 16. The asphalt layer 18 is laid by laying and smoothing a heated and softened asphalt mixture on the second bonding layer 16 by, for example, an asphalt finisher, and rolling by a rolling machine.

Figure 5:
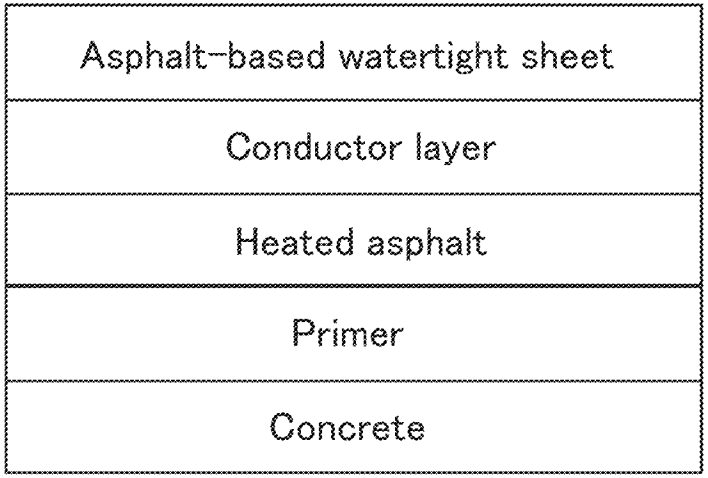
FIG. 5 shows a test sample configuration used in an experiment for checking a state of an asphalt layer when a corrosion-resistant conductive sheet is heated.

EXAMPLES (1) Test for Checking a Test of an Asphalt Layer by Heating a Corrosion-Resistant Conductive Sheet A test sample using the corrosion-resistant conductive sheet according to the present invention was heated to conduct a test to check a state of the asphalt layer. FIG. 5 shows a configuration of the test sample used in the test. As shown in FIG. 5, in the test sample, 0.2 litter/$m^2$ of a primer (styrene-butadiene copolymer+petroleum resin+toluene) was coated on the upper surface of concrete which becomes a base layer (300 mm×300 mm×60 mm), and 1.2 kg/$m^2$ of heated asphalt (asphalt+petroleum-based hydrocarbon+petroleum resin+styrene-butadiene copolymer) was further coated on the upper surface thereof. A conductor layer was laid on the upper surface of the heated asphalt, and an asphalt-based watertight sheet was laid on the upper surface thereon. As a conductor layer, four sheets; a corrosion-resistant conductive sheet (described as IH alminium in FIG. 5), an alminium sheet (described as alminium in FIG. 5), an FRP sheet, and a stainless steel sheet were used. An electromagnetic coil having a diameter of 28.5 cm was used to heat the test sample from above the asphalt-based watertight sheet to check the state of the asphalt layer. Test results are as follows.

(a) In the test sample using the corrosion-resistant conductive sheet, the heated asphalt started to melt when the corrosion-resistant conductive sheet became 60° C. or more by electromagnetic induction heating. The asphalt watertight sheet did not reach a melting state, but a softened state was confirmed.

(b) In the test sample using the alminium sheet, the heated asphalt started to melt when the alminium sheet became 60° C. or more by electromagnetic induction heating. The asphalt watertight sheet did not reach a melting state, but a softened state was confirmed.

(c) In the test sample using the FRP sheet, the FRP sheet was not heated by electromagnetic induction, and neither of the heated asphalt and the asphalt watertight sheet melted.

(d) In the test sample using the stainless steel sheet, the heated asphalt started to melt when the stainless steel sheet became 60° C. or more by electromagnetic induction heating. The asphalt watertight sheet did not reach a melting state, but a softened state was confirmed.

(2) A Heating Test when Ends of the Corrosion-Resistant Conductive Sheets are Overlapped Two conductor layers of A4 size (210 mm×297 mm) were prepared to make a test sample by making the ends of these conductor layers overlapped with each other by 100 mm, and a heating test was conducted using an electromagnetic induction coil having a diameter of 28.6 cm. As a conductor layer, four sheets; a corrosion-resistant conductive sheet, an alminium sheet, an FRP sheet, and a stainless steel sheet were used. Details of these sheets are the same as what have been used in the test in (1) above.

Test results are as follows.

(a) In the test sample using the corrosion-resistant conductive sheet, the entire sheet could be heated evenly.

(b) In the test sample using the alminium sheet, the entire sheet could not be heated evenly, and the overlapped ends were intensively heated and ignited.

(c) In the test sample using the FRP sheet, the sheet was not heated.

(d) In the test sample using the stainless steel sheet, the entire sheet was heated evenly.

(3) Corrosion-Resistance Test and Electrical Specific Resistance Measurement of the Corrosion-Resistant Conductive Sheet A corrosion-resistance test was conducted for the corrosion-resistant conductive sheet according to the present invention to check as to whether corrosion has occurred. At the same time, measurement of electrical specific resistance and an electromagnetic induction heating characteristic test are also conducted. Table 1 shows a configuration for each test sample, and chemicals used in the corrosion resistance test for Examples 1 to 6 and Comparative Examples 1 and 2.

The followings were used as test samples.

Examples 1 and 2

A laminate material, formed by coating an epoxy-based resin by 3 g/m$^2$ per one surface on a basis of solid content on each surface of an alminium foil (described as IH foil in Table 1) having a thickness of 80 μm and components of Mn=1.76, Mg=0.85, Fe=0.06, Ti=0.02, other components each having 0.01 or less (weight %), and Al=remnant, was used.

Examples 3 and 4

A laminate material, formed by coating a silica-based glass by 3 g/m$^2$ per one surface on a basis of solid content on each surface of an alminium foil (described as IH foil in Table 1) having a thickness of 80 μm components of Mn=1.76, Mg=0.85, Fe=0.06, Ti=0.02, other components each having 0.01 or less (weight %), and Al=remnant, was used.

Examples 5 and 6

A stainless steel foil having a thickness of 80 μm was directly used.

Comparative Examples 1 and 2

An alminium foil having a thickness of 80 μm, with an alloy number 1N30 (described as a general foil in Table 1) was directly used.

In the corrosion resistance test, each test sample (100 mm×100 mm) was immersed in Ca $(OH)_2$ 0.17 WL % water solution (saturated calcium hydroxide solution) (described as Chemical A in Table 1), or NaCl3 wt % water solution (3% salt solution) (described as Chemical B in Table 1), and a surface state was observed visually after 15 days. In Table 1, a ○ mark shows that the test sample had no change in color or corrosion, and x mark shows that the test sample was corroded, and a through-hole was made.

The electrical specific resistance (μΩ·cm) was measured at a room temperature (15° C.) by a direct current four-terminal method for each test sample. In addition, an IH characteristic test was conducted by using a commercially available IH cooking device (power of 1400 W) to examine as to whether the metal foil (a thickness of 80 μm) used for each of the test samples reaches 90° C. from the room temperature within 10 seconds. In addition, an infrared camera was used to check as to whether heating is done uniformly. In Table 1, the ○ mark shows that the temperature of the test sample reached 90° C. within 10 seconds and also the test sample was uniformly heated, and the x mark shows that the temperature of the test sample did not rise.

TABLE 1

| | Test sample | Chemical | Corrosion resistance | Electrical specific resistance | IH characteristic |
|---|---|---|---|---|---|
| Example 1 | Epoxy coat/ IH foil/ Epoxy coat | A | ○ | 8.4 | ○ |
| Example 2 | Epoxy coat/ IH foil/ Epoxy coat | B | ○ | 8.4 | ○ |
| Example 3 | Epoxy coat/ IH foil/ Glass coat | A | ○ | 8.4 | ○ |
| Example 4 | Epoxy coat/ IH foil/ Glass coat | B | ○ | 8.4 | ○ |
| Example 5 | Stainless steel foil | A | ○ | 72 | ○ |
| Example 6 | Stainless steel foil | B | ○ | 72 | ○ |
| Comparative example 1 | General foil | A | × | 3.0 | × |
| Comparative example 2 | General foil | B | × | 3.0 | × |

What is claimed is:

1. A road structure comprising:

a non-thermoplastic base layer;

an asphalt layer located above the base layer;

a conductive sheet between the base layer and the asphalt layer, wherein the conductive sheet is configured to generate heat based on electromagnetic induction;

a first bonding layer that bonds the conductive sheet and the base layer; and a second bonding layer that bonds the conductive sheet and the asphalt layer, wherein at least the first bonding layer is a thermoplastic bonding layer configured to be softened by the heat, wherein the conductive sheet is any one of a metal layer including a corrosion-resistant film, a corrosion-resistant metal layer, a fiber layer including a corrosion-resistant film, a corrosion-resistant fiber layer, a resin layer including a corrosion-resistant film, a corrosion-resistant resin layer, a layer including a corrosion-resistant film attached to a mixture of a resin and an electrical conductor, and a layer in which a corrosion-resistant resin is mixed with a conductor, and wherein the corrosion-resistant film is at least one of a glass-based film, a fluorinated film, an acrylic film, a styrene film, polycarbonate film, a polyester film, a polyurethane film, an epoxy film, a Teflon (Registered Trademark) film, a tin plating, a zinc plating, a zinc alloy clad, an oxide film, a phosphate treatment film, a phosphoric salt treatment film, a chromic acid treatment film, a chromate salt treatment film, a hydrofluoric acid treatment film, a hydrofluoric acid salt treatment film, a sodium salt treatment film, and a passive oxide film of any one selected from a group consisting of niobium, titanium, tantalum, silicon and zirconium formed by a cathode oxidation method, a sol-gel method, an alkoxide method, a CVD method or a PVD method.

2. The road structure according to claim 1, wherein a metal used for the corrosion-resistant conductive sheet is any one selected from a group consisting of aluminium, stainless steel, iron, zinc, copper, titanium, and an alloy composed at least two of aluminium, stainless steel, iron, zinc, copper and titanium.

3. The road structure according to claim 2, wherein the aluminium or the alloy composed mostly of aluminium has an electrical specific resistance of 6.0 μΩ·cm or more.

4. The road structure according to claim 1, wherein the first bonding layer is one selected from or a mixture of two or more selected from the group consisting of synthetic rubber, acrylic resin, epoxy resin, acrylic acid, methacrylic acid, acrylic radical curable liquid resin, polyurethane resin, ethylene-vinyl acetate copolymer, urethane resin and bituminous material.

5. The road structure according to claim 1, wherein the second bonding layer is one selected from or a mixture of two or more selected from a group consisting of ethylene-vinyl acetate copolymer, polyolefin resin, polyamide resin, polyester resin, polyurethane resin, polystyrene resin, polypropylene resin, polyvinyl acetate resin, polyethylene resin, polyethylene terephthalate resin, polyamide-imide resin, styrene-butadiene block copolymer (SBS) resin, chloroprene (CR) resin, styrene-isoprene block copolymer (SIS) resin, polybutadiene resin, and bituminous material.

6. The road structure according to claim 1, wherein a softening point of the first bonding layer is lower than a softening point of the second bonding layer.

7. The road structure according to claim 1, comprising a watertight layer between the first bonding layer and the base layer.

8. A corrosion-resistant conductive sheet used for the road structure according to claim 1.

9. The corrosion-resistant conductive sheet according to claim 8, wherein the corrosion-resistant film is laminated on each side of the conductor layer.

10. The corrosion-resistant conductive sheet according to claim 9, wherein the corrosion-resistant film is at least one of a glass-based film, a fluorinated film, an acrylic film, a styrene film, polycarbonate film, a polyester film, a polyurethane film, an epoxy film, a Teflon (Registered Trademark) film, a tin plating, a zinc plating, a zinc alloy clad, an oxide film, a phosphate treatment film, a phosphoric salt treatment film, a chromic acid treatment film, a chromate salt treatment film, a hydrofluoric acid treatment film, a hydrofluoric acid salt treatment film, a sodium salt treatment film, and a passive oxide film of any one selected from a group consisting of niobium, titanium, tantalum, silicon and zirconium formed by a cathode oxidation method, a sol-gel method, an alkoxide method, a CVD method or a PVD method.

11. The corrosion-resistant conductive sheet according to claim 8, wherein the conductor layer is any one of a metal layer, a fiber layer, a resin layer, or a layer in which a resin is mixed with a conductor.

12. The corrosion-resistant conductive sheet according to claim 11, wherein a metal used for the conductor layer is any one of a metal selected from a group consisting of aluminium, stainless steel, iron, zinc, copper, and titanium, and an alloy composed at least two of aluminium, stainless steel, iron, zinc, copper and titanium.

13. The corrosion-resistant conductive sheet according to claim 12, wherein the aluminium or the alloy composed mostly of aluminium has an electrical specific resistance of 6.0μΩ·cm or more.

14. A method for peeling off an asphalt layer from a base layer in the road structure according to claim 1, comprising:

softening the first bonding layer by subjecting the corrosion-resistant conductive sheet to electromagnetic induction heating from a side of the asphalt layer; and peeling the first bonding layer off the base layer to separate the base layer and the asphalt layer.

15. The method according to claim 14, further comprising:

softening the second bonding layer by subjecting the corrosion-resistant conductive sheet to electromagnetic induction heating from the side of the asphalt layer; wherein the separating step includes, at a position of the softened first bonding layer and the second bonding layer, separating a layer located above the position and a layer located under the position.

16. The method according to claim 14, wherein the first bonding layer is any one selected from or a mixture of at least two selected from a group consisting of synthetic rubber, acrylic resin, epoxy resin, acrylic acid, methacrylic acid, acrylic radical curable liquid resin, polyurethane resin, ethylene-vinyl acetate copolymer, urethane resin and bituminous material.

17. The method according to claim 14, wherein the second bonding layer is any one selected from or a mixture of at least two selected from a group consisting of ethylene-vinyl acetate copolymer, polyolefin resin, polyamide resin, polyester resin, polyurethane resin, polystyrene resin, polypropylene resin, polyvinyl acetate resin, polyethylene resin, polyethylene terephthalate resin, polyamide-imide resin, styrene-butadiene block copolymer (SBS) resin, chloroprene (CR) resin, styrene-isoprene block copolymer (SIS) resin, polybutadiene resin, and bituminous material.

18. The method according to claim 14, wherein a softening point of the first bonding layer is lower than a softening point of the second bonding layer.

* * * * *